United States Patent [19]

Wackerbarth et al.

[11] 4,357,211

[45] Nov. 2, 1982

[54] AIR CONTROL ARRANGEMENT FOR REGENERATIVELY-HEATED COKE OVENS

[75] Inventors: Folkard Wackerbarth; Gerd Halbherr; Horst Kuhlmann, all of Bochum, Fed. Rep. of Germany

[73] Assignee: Dr. C. Otto & Comp. G.m.b.H., Bochum, Fed. Rep. of Germany

[21] Appl. No.: 259,050

[22] Filed: Apr. 30, 1981

[30] Foreign Application Priority Data

May 14, 1980 [DE] Fed. Rep. of Germany ..... 3018361

[51] Int. Cl.[3] ..... C10B 5/12; C10B 21/06; C10B 21/10

[52] U.S. Cl. ..... 202/111; 202/142; 202/151

[58] Field of Search ..... 202/111, 123, 130, 141–144, 202/146, 151, 239, 270

[56] References Cited

U.S. PATENT DOCUMENTS

| | | | |
|---|---|---|---|
| 2,971,895 | 2/1961 | Van Ackeren | 202/151 |
| 3,250,686 | 5/1966 | Rossow et al. | 202/151 |
| 3,433,716 | 3/1969 | Tucker | 202/151 |
| 3,751,342 | 8/1973 | Gidick | 202/151 |
| 3,833,478 | 9/1974 | Tucker | 202/151 |
| 4,085,008 | 4/1978 | Kinzler | 202/151 |
| 4,098,289 | 7/1978 | Schluter et al. | 202/270 |

*Primary Examiner*—Bradley Garris
*Attorney, Agent, or Firm*—Thomas H. Murray

[57] ABSTRACT

A coke oven adapted to be regeneratively heated by lean gas or rich gas at choice, characterized in that control flaps are disposed in air inlet chests for the coke oven regenerator and are connected through linkages to a common actuating rod extending along the coke oven battery. Reciprocation of the actuating rod in one direction or the other will open or close all flaps essentially simultaneously to rapidly change the quantity of combustion-supporting air supplied to the regenerator, depending upon whether lean or rich gas is being used.

1 Claim, 5 Drawing Figures

AIR CONTROL ARRANGEMENT FOR REGENERATIVELY-HEATED COKE OVENS

BACKGROUND OF THE INVENTION

In regeneratively-heated coke oven batteries, the air required for combustion is taken into the sole flue at the base of the regenerator chambers through air chests provided with flaps that can be adjusted to regulate the amount of air entering the regenerator chambers, depending upon whether a rich gas or lean gas is being burned. Coke ovens of this type occasionally have to be changed over to a different operating mode; and the changeover has to be carried out rapidly. The changeover involves increasing or decreasing the combustible gas supply, a step which can be carried out readily and rapidly. At the same time, the quantity of air per unit of time must be altered with the quantity of gas supplied. The air to be preheated is supplied through openings in air intake chests spaced along the oven battery, such openings being closable by air flaps. In the past, alteration in the gas supply required an alteration in the positions of the air flaps controlling the size of the air chest openings.

A special problem arises in the case of coking plants such as, for example, blast furnace coking plants where it is required to operate intermittently with a lean gas requiring preheating (i.e., blast furnace stack gas) followed by an abrupt changeover to coke oven gas, and vice versa. The quantities of air required to support combustion with these two types of gas differ considerably from one another. Similar circumstances are found in coke oven plants where a changeover is made from non-preheated coke oven gas to gases requiring preheating and vice versa.

SUMMARY OF THE INVENTION

In accordance with the present invention, control elements are provided for a coke oven battery enabling the quantity of combustion-supporting air supplied to the regenerators per unit of time to be varied up or down rapidly for adaptation to special operating conditions which must be observed when different kinds of gas are used for heating.

Specifically, the invention provides a means wherein auxiliary control flaps are provided within the air inlet chests for a coke oven battery, which flaps are pivotal around pivots disposed perpendicularly to the flow direction and are adapted to be actuated by a common actuating rod extending along the battery. Preferably, the control flaps are rotatable around vertical pivots extending between the top and bottom of the air inlet chests. The top of each pivot is connected to a radially-extending arm, these arms being pivotally interconnected through a link in a quadrilateral arrangement whereby rotation of one pivot in one direction will cause rotation of the other pivot in the opposite direction. Additionally, one of the pivots is connected through a second arm to the aforesaid common actuating rod extending along the battery, preferably through a pin on the rod which extends into a slot in the aforesaid second arm connected to a pivot.

The above and other objects and features of the invention will become apparent from the following detailed description taken in connection with the accompanying drawings which form a part of this specification, and in which.

Figure 1:
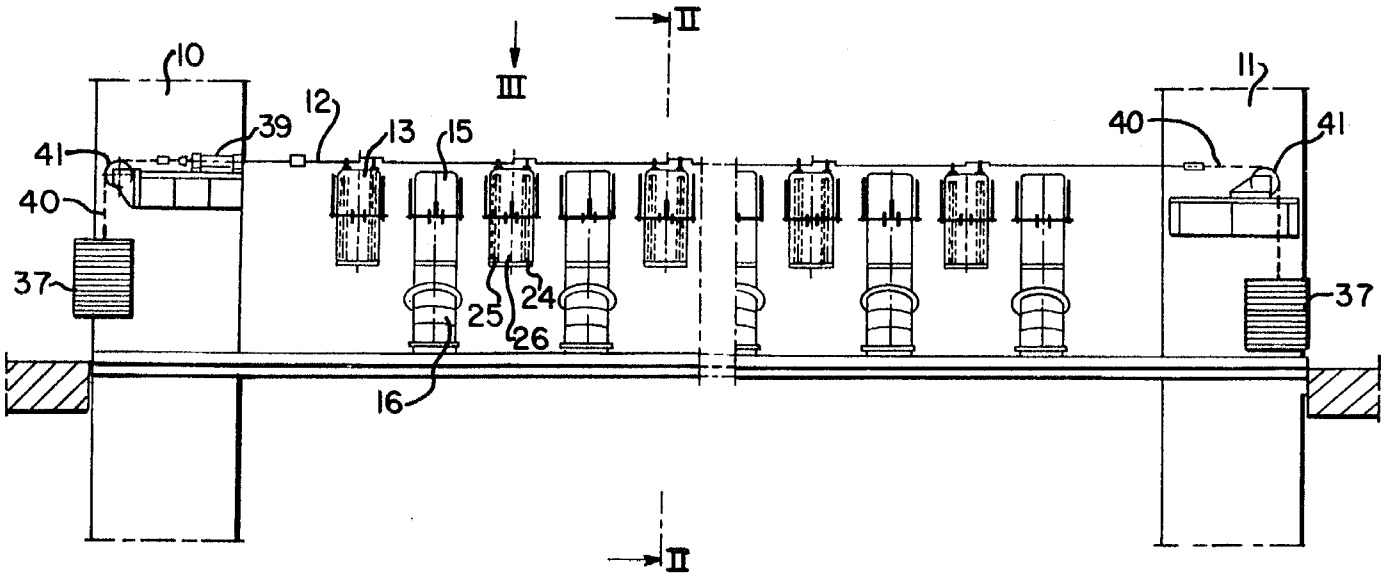
FIG. 1 is a plan view of the bottom portion of a regenerative coke oven battery showing the air inlet chests with which the present invention is used.

With reference now to the drawings, and particularly to FIG. 1, coke oven battery heads 10 and 11 are shown, these heads being at the ends of a plurality of coke oven chambers, not shown. Extending between the heads 10 and 11 is an actuating rod 12, hereinafter described in greater detail. Air inlet chests 13 serve to introduce air into a regenerator bottom flue 14 (FIG. 2); while inlet chests 15 are employed to introduce air on rich gas heating and for the supply of lean gas on lean gas heating, the lean gas being supplied through conduits 16 which incorporate valves, not shown, which are opened or closed by changeover means. A buckstay 17 braces the oven masonry 18 above the bottom flue 14 as best shown in FIG. 2.

Figure 2:
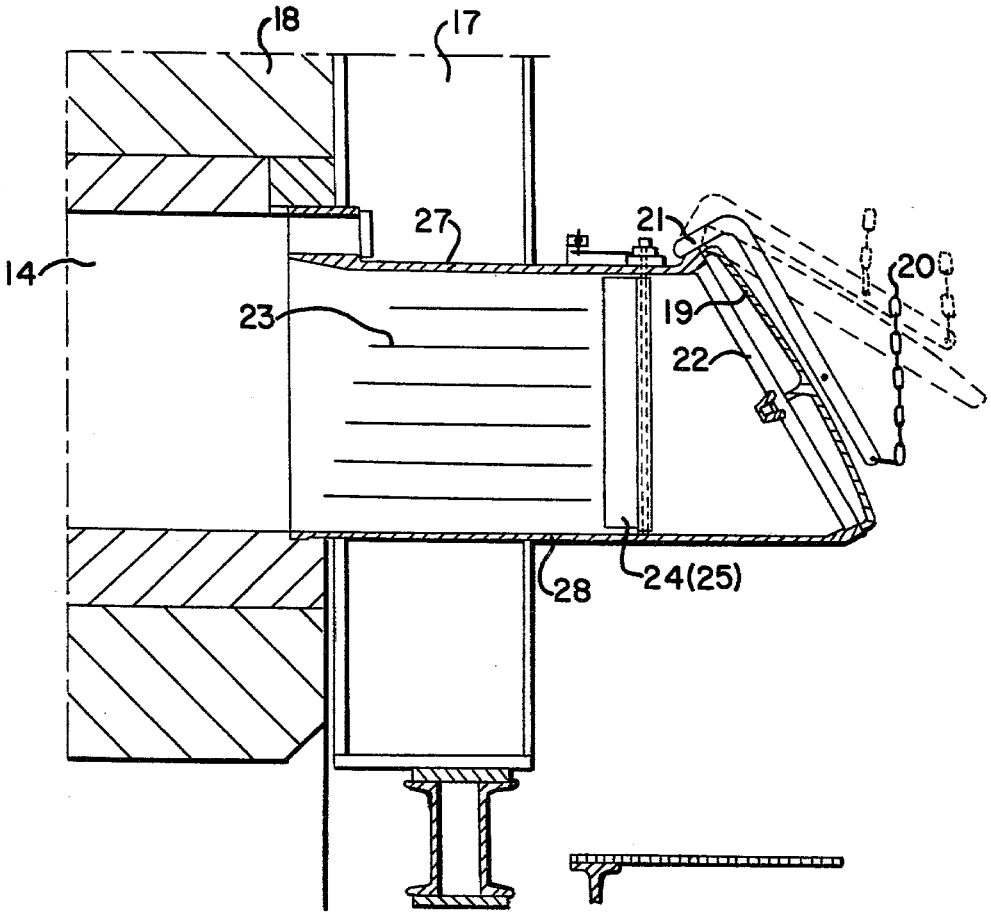
FIG. 2 is a vertical cross-sectional view taken substantially along line II—II of FIG. 1 showing the details of a typical air inlet chest.
Figure 3:
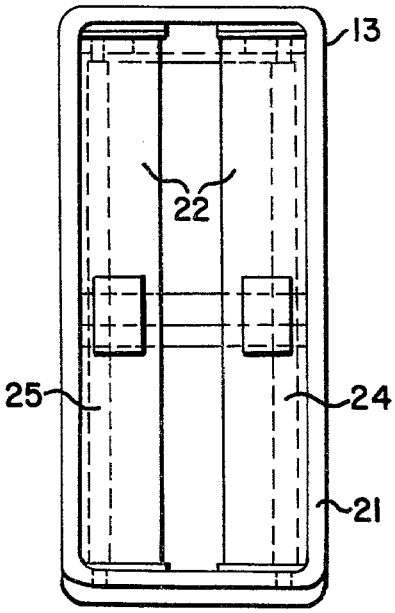
FIG. 3 is an end view of an air flap for the chests of FIG. 1.

An air flap 19 for each inlet chest 13 can be raised from the solid-line position to the broken-line position shown in FIG. 2 by means of a chain 20. Restrictor or throttle plates 22 (see also FIG. 3) are carried on a frame 21 which acts as a seal against which the flap 19 is adapted to engage. Throttle plates 22 serve to control the quantity of air supplied to each individual chest 13. Horizontal guides 23 are disposed one above another within the air chests 13 to produce a laminar flow of air entering the regenerator bottom flue 14.

Figure 4:
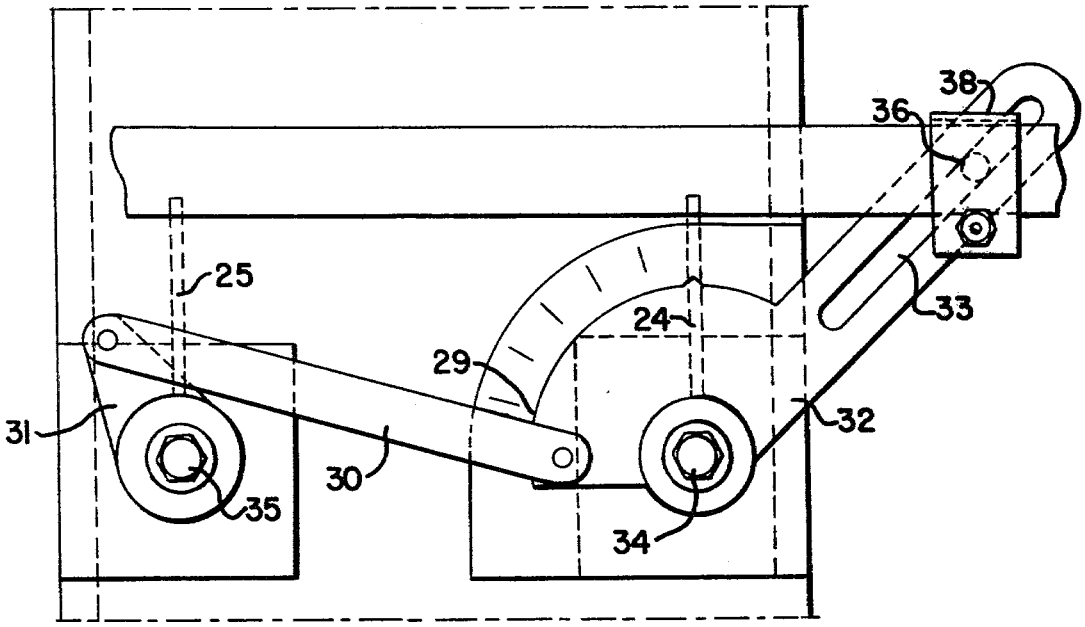
FIG. 4 is a top view of an air inlet chest showing the positions of the flaps of the present invention and the control linkages therefor when the flaps are open.
Figure 5:
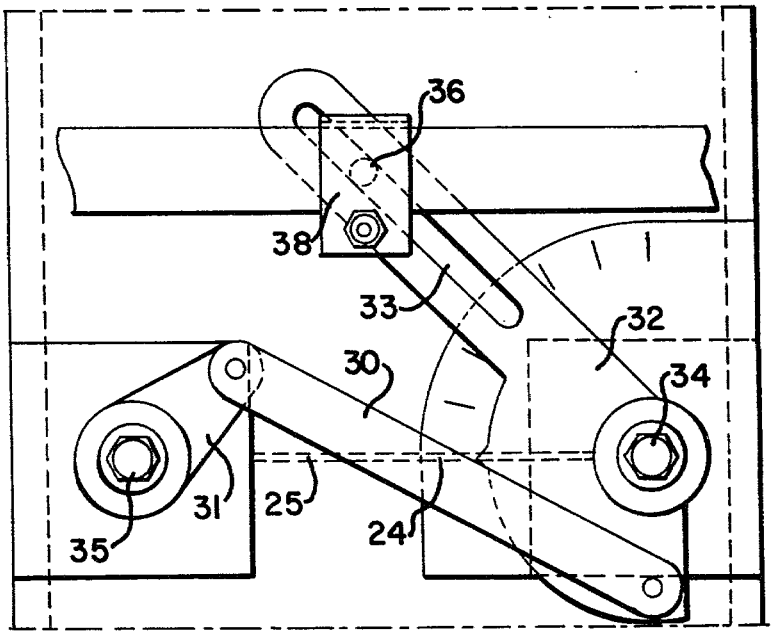
FIG. 5 is a top view of an air inlet chest similar to that of FIG. 4 but showing the positions of the flaps and their associated linkages when the flaps are closed.

The present invention relates to adjustable control flaps 24, 25 which are rotatable about pivot pins 34, 35 (FIG. 4) closely adjacent the side walls of each chest 13. The pivot pins 34 and 35 are journaled on the top 27 and bottom 28 of each chest 13. The upper ends of the pivots 34 and 35, as best shown in FIGS. 4 and 5, are coupled to linkage arm 31 and segment 29, which also acts as an arm means, interconnected in a guadrilateral arrangement by means of a link arm 30. That is, the flaps 24 and 25 can be rotated simultaneously from the open position shown in FIG. 4 to the closed position shown in FIG. 5 by rotating a second arm 32 on segment 29, for example, in a counterclockwise direction. After the flaps are closed, they can then be opened by rotating the arm 32 in the opposite direction. The arm 32 is provided with a slot 33 which receives a pin 36 carried on a clamping member 38 secured to the actuating rod 12. Thus, as the actuating rod moves to the left as viewed in FIGS. 4 and 5, the arms 31 and 32 rotate in opposite directions to close the flaps; while movement of the rod 12 to the right will cause rotation of the flaps into open positions. The rod 12 is adapted to be actuated by a hydraulic cylinder 39 (FIG. 1), the ends of the rod being connected to chains which pass over pulleys 41 and have weights 37 connected thereto. The weights 37 act as counterweights, as will be apparent.

In operation, it will be observed that when the flaps 24 and 25 are in the positions shown in FIG. 4 where they are disposed parallel to the direction of airflow, very little resistance will be presented to the movement of air into the sole flue 14. When the cylinder 39 is actuated in the opposite sense, however, the flaps 24, 25 will be rotated into the positions shown in FIG. 5 where they are transverse to the airflow direction and present maximum resistance to airflow. Rod 12 can be set in an intermediate position to partially close or open the flaps 24, 25, as will be understood. Thus, the quantity of air supplied to the regenerators can be adjusted by simply adjusting the rod 12.

The battery can be changed over immediately from one kind of gas (e.g., a preheated gas) to a different gas (e.g., coke oven gas) by operation of the rod 12. This obviates the need for altering each individual flap 19 (FIG. 2), a job requiring manual manipulation. If, for example, the coke oven battery is being heated with blast furnace gas, the air inlet chests 13 will have been adjusted by appropriate positioning of the flaps 19 for the quantity of combustion-supporting air necessary for heating using blast furnace gas. If it is then required to changeover to heating the coke oven gas, the flaps 34, 35 at the inlet chests 13 are rotated by operation of the rod 12 to reduce the quantity of entering air required for coke oven gas. If it is then desired to return to blast furnace gas operation, the rod 12 is actuated in the opposite direction to return the flaps 34 and 35 to their previous, open positions.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. In a coke oven battery adapted to be regeneratively heated by either rich gas or lean gas and including air inlet chests spaced along the battery for admitting air to the sole flue of the coke oven battery; the improvement comprising:

a device for controlling the rate of flow of gas through said air inlet chests comprising:

first and second flap members which are adapted to move between a first position essentially parallel to the flow of said gas and a second position essentially perpendicular to the flow of said gas, first and second pivot members along which said first and second flap members are mounted for pivotal movement between said first and second positions, an arm connected at a first end to said first pivot member and pivotally connected at a second end to a first end of a link member, an actuating rod adapted to be moved axially in a direction perpendicular to the central axes of said first and second pivot members, said actuating rod bearing a pin, and a member affixed to said second pivot member which bears an arm and having therein a slot adapted slidingly to receive said pin on said actuating rod, said member having a pivotal connection to a second and opposite end of said link member.

* * * * *